US007930916B2

(12) United States Patent
Tamezane et al.

(10) Patent No.: US 7,930,916 B2
(45) **Date of Patent: *Apr. 26, 2011**

(54) LOCKING DEVICE AND KEY

(75) Inventors: Takumi Tamezane, Aichi-ken (JP); Toshiharu Katagiri, Aichi-ken (JP)

(73) Assignee: Kabushiki Kaisha Tokai-Rika-Denki-Seisakusho, Aichi-Ken (JP)

( * ) Notice: Subject to any disclaimer, the term of this patent is extended or adjusted under 35 U.S.C. 154(b) by 899 days.

This patent is subject to a terminal disclaimer.

(21) Appl. No.: 11/686,191

(22) Filed: Mar. 14, 2007

(65) Prior Publication Data

US 2007/0214847 A1 Sep. 20, 2007

(30) Foreign Application Priority Data

Mar. 15, 2006 (JP) ..... 2006-071083
Mar. 15, 2006 (JP) ..... 2006-071084
Mar. 15, 2006 (JP) ..... 2006-071085

(51) Int. Cl.
*E05B 27/00* (2006.01)

(52) U.S. Cl. ..... 70/387; 70/222; 70/352; 70/361; 70/419; 70/DIG. 20

(58) Field of Classification Search ..... 70/361, 70/379 R, 387, 377, 188, 189, 222, 338, 345, 70/352, 405, 419, 422, DIG. 20
See application file for complete search history.

(56) References Cited

U.S. PATENT DOCUMENTS 957,938 A 5/1910 Cox
1,288,074 A 12/1918 Lutz
1,887,016 A * 11/1932 Hagstrom et al. ..... 70/361
2,454,926 A 11/1948 Jacobi
2,683,978 A 7/1954 Jacobi
3,455,128 A * 7/1969 Tenkoff ..... 70/361
3,659,444 A * 5/1972 Wellekens ..... 70/379 R
4,418,554 A * 12/1983 Wolfgang ..... 70/361
4,759,204 A 7/1988 Neyret
4,903,512 A 2/1990 Leroy et al.
4,905,487 A 3/1990 Morikawa et al.
5,138,856 A * 8/1992 Chyun ..... 70/379 R
5,146,770 A * 9/1992 Yun-Sheng ..... 70/387
5,181,407 A * 1/1993 Wu ..... 70/361
5,265,453 A 11/1993 Konii et al.
5,265,455 A 11/1993 Grimmer (Continued)

FOREIGN PATENT DOCUMENTS

JP 5-59849 A 3/1993

(Continued)

*Primary Examiner* — Lloyd A Gall
*Assistant Examiner* — Christopher Boswell
(74) *Attorney, Agent, or Firm* — Roberts Mlotkowski Safran & Cole P.C.

(57) ABSTRACT

There is disclosed a key required to have a reduced mechanical strength. When an authentic key is inserted into the keyway in a locking device, only a plunger member starts to move from a standby position toward an operative position. When the plunger member is pushed to the operative position, an operating lever located in the locked position swings to the unlocked position. The operating lever unlocks a locking mechanism that is in a locked state. When an inauthentic key is inserted in the keyway, the plunger member and sleeve member move together to the operative position. The operating lever in the locked position does not swing. Thus, the operating lever maintains the body portion of the locking mechanism locked.

16 Claims, 6 Drawing Sheets

U.S. PATENT DOCUMENTS

| | | | | |
|---|---|---|---|---|
| 5,295,377 | A * | 3/1994 | Moricz et al. | 70/379 R |
| 5,640,864 | A | 6/1997 | Miyamoto | |
| 5,722,275 | A | 3/1998 | Price et al. | |
| 5,732,580 | A | 3/1998 | Garnault et al. | |
| 5,765,417 | A | 6/1998 | Bolton | |
| 6,098,434 | A * | 8/2000 | Liou | 70/361 |
| 6,523,382 | B1 | 2/2003 | Dimig et al. | |
| 6,761,052 | B2 * | 7/2004 | Buschmann | 70/361 |
| 6,776,016 | B1 | 8/2004 | Wittwer et al. | |
| 6,978,645 | B2 * | 12/2005 | Shimon | 70/379 R |
| 7,716,960 | B2 * | 5/2010 | Tamezane et al. | 70/361 |
| 2003/0172695 | A1 * | 9/2003 | Buschmann | 70/361 |

FOREIGN PATENT DOCUMENTS

| | | | |
|---|---|---|---|
| JP | 8-4387 | A | 1/1996 |
| WO | 02/27124 | A1 | 4/2002 |

* cited by examiner

10
IA
IB
H
W
S

120
IVA
IVB
H
W
S

LOCKING DEVICE AND KEY

CROSS-REFERENCE TO RELATED APPLICATION

This application claims priority under 35 USC 119 from Japanese Patent Application, Nos. 2006-71083, 2006-71084 and 2006-71085, the disclosure of which is incorporated by reference herein.

BACKGROUND OF THE INVENTION

1. Field of the Invention

The present invention relates to a locking device for use with a key which is inserted into the keyway to thereby either operate a manipulated mechanism to be key-operated or maintain the mechanism in its inoperative state. The invention also relates to the key for use with this locking device.

2. Description of the Related Art

A known locking device mounted in an automotive door or the like is described, for example, in Japanese Patent Application Laid-open No. 8-4387. This locking device has a cylindrical rotor case, a sleeve rotatably housed in the rotor case, a key rotor rotatably mounted in the sleeve and provided with a keyway, a rear rotor rotatably mounted so as to oppose to the key rotor in the axial direction, and a lock lever mounted to be capable of integrally rotating with the rear rotor.

With the aforementioned locking device, if an authentic key is inserted into the keyway, the key rotor and rear rotor are coupled together such that they rotate as a unit. Thus, if the authentic key inserted in the key rotor is rotated, the key rotor, rear rotor, and lock lever rotate together with the authentic key. Manipulating force from the lock lever unlocks the locking mechanism in a vehicular door or the like.

Meanwhile, if a key different in shape with the authentic key or a key substitute such as a screwdriver (hereinafter collectively referred to as inauthentic keys) is inserted into the keyway in the key rotor and forcedly rotated, the key rotor and sleeve rotate together. The key rotor is disconnected from the rear rotor, permitting the key rotor to rotate freely. Consequently, if the inauthentic key inserted in the key rotor is rotated, the key rotor and sleeve rotate together idly but neither the rear rotor nor the lock lever rotates. The manipulating force from the lock lever is not transmitted to the lock mechanism. Hence, the locking mechanism is prevented from being unlocked.

In the above-described locking device, plural disk tumblers are radially movably disposed in the key rotor. If an elongated, plate-shaped key is inserted into the keyway, the disk tumblers are brought into engagement with their respective engagement portions spaced from each other and formed on one (engagement surface) of the surfaces provided at both sides in the thickness direction of the key. At this time, if all the disk tumblers of this locking device engage their respective correct engagement portions and move into their normal positions corresponding to the correct engagement portions (normal position) in the radial direction, the key rotor and rear rotor are coupled together such that they can rotate as a unit. The key rotor will be disconnected from the rear rotor if at least one disk tumbler engages an incorrect engagement portion and is not moved into its correct position radially.

That is, if the authentic key is inserted into the keyway and all the disk tumblers engaging with their respective engagement portions of the authentic key are moved into their normal positions, the locking mechanism can be unlocked by rotating the authentic key. Where an inauthentic key is inserted into the keyway and at least one disk tumbler is not moved into its normal position, even if the inauthentic key is forcedly rotated, the key rotor and sleeve rotate idly. Consequently, the locking mechanism is not unlocked. Furthermore, no excessive force is applied to the various components. Hence, the components are prevented from being damaged.

With the above-described locking device, during unlocking, the key must be rotated against the resistances of the key rotor, rear rotor, and lock lever which are produced when they rotate and also against the operative resistance of the locking mechanism. In consequence, considerably large torque is transmitted from the key to the key rotor. Accordingly, in order to prevent deformation of the key certainly, it is necessary to provide a sufficiently large strength to the key in the key-twisting direction. Therefore, the material of the key used with the above-described locking device is limited to materials showing high strength such as iron and stainless steel. In addition, it is necessary to increase the thickness of the wall of the key sufficiently according to the magnitude of the transmitted torque.

Furthermore, the plural disk tumblers disposed in the key rotor are arranged in the axial direction. When the key is inserted into the keyway, the tumblers come into engagement with engagement portions of the key engagement surface which are spaced from each other in the longitudinal direction. Therefore, to diversify the kinds of keys (i.e., combinations of the engagement portions), it is necessary to increase the number of the disk tumblers and the number of installed engagement portions of the key. If the number of the disk tumblers and the number of installed engagement portions of the key are increased, the total length of the device and the total length of the key are inevitably increased.

SUMMARY OF THE INVENTION

It is an object of the present invention to provide a locking device which is for use with a key having reduced mechanical strength and which can effectively suppress increases in total length of the locking device and key even if the number of engaging members coming into engagement with engagement portions of the key is increased.

It is another object of the invention to provide a key which is for use with a locking device and effectively suppress increases in total length of the key if the number of engagement portions is increased with which engaging members of the locking device are brought into engagement when the key is inserted into the keyway.

A first embodiment of the present invention provides a locking device having: a cylindrical case member having an internal space extending in an axial direction; a cylindrical plunger member disposed inside the case member and supported by the case member so as to be movable between a given standby position and a given operative position in the axial direction; a keyway which is formed inside the plunger member and extends in the axial direction and into which a key can be inserted from axially outside the plunger member when the plunger member is in the standby position; and operation-selecting portions. When an authentic key is inserted in the keyway and the plunger member moves from the standby position to the operative position together with the authentic key, the operation-selecting portions operates a key-operated mechanism. When an inauthentic key is inserted in the keyway and the plunger member moves from the standby position to the operative position together with the inauthentic key, the operation-selecting means maintains the key-operated mechanism in an inoperative state.

According to the above-described first embodiment, when an operator inserts a key which may be authentic or inauthentic (hereinafter they are generalized and simply referred to as "key") into the keyway, the key-operated mechanism can be operated or maintained in an inoperative state simply by pushing the key. It is not necessary to transmit torque by the key during manipulation of the key, unlike the rotary locking device in which the key-operated mechanism is manipulated by rotating the key after inserting the key into the keyway and load is applied to the key only in the axial direction. Therefore, the required mechanical strength of the key in the twisting direction can be made sufficiently small.

A second embodiment of the present invention provides a locking device having: (a) a cylindrical case member having an internal space extending in an axial direction; (b) a cylindrical sleeve member disposed inside the case member and supported by the case member so as to be movable between a given standby position and a given operative position in the axial direction; (c) a plunger member disposed inside the sleeve member so as to be movable in the axial direction, the plunger member being so supported by the case member via the sleeve member as to be movable between the standby position and the operative position in the axial direction; (d) a keyway which is formed inside the plunger member and extends in the axial direction and into which a key can be inserted from axially outside the plunger member when the plunger member is in the standby position; (e) a key-judging unit which, when an inauthentic key is inserted in the keyway, connects the sleeve member with the plunger member such that the sleeve member and the plunger member move together in the axial direction and which, when an authentic key is inserted in the keyway, disconnects the sleeve member from the plunger member; and (f) an interlocking unit. When an authentic key is inserted in the keyway and the plunger member is moved together with the authentic key into the operative position while the sleeve member disconnected from the plunger member by the key-judging unit is left in the standby position, the interlocking unit operates a key-operated mechanism. When an inauthentic key is inserted in the keyway and the sleeve member and the plunger member connected together by the key-judging unit are moved into the operative position together with the inauthentic key, the interlocking unit maintains the key-operated mechanism in an inoperative state.

According to the second embodiment described above, when an authentic key is inserted in the keyway and only the plunger member disconnected from the sleeve member by the key-judging unit is moved into the operative position together with the authentic key while the sleeve member is left in the standby position, the interlocking unit operates the key-operated mechanism. When an inauthentic key is inserted in the keyway and the sleeve member and the plunger member connected together by the key-judging unit are moved into the operative position together with the inauthentic key, the interlocking unit maintains the key-operated mechanism in an inoperative state. Consequently, the operator can operate the key-operated mechanism with the interlocking unit by inserting an authentic key into the keyway and pushing the key in the axial direction to move it from the standby position into the operative position. If an operator inserts an inauthentic key into the keyway and pushes the key to move the plunger member and sleeve member from the standby position into the operative position, the interlocking unit maintains the key-operated mechanism in an inoperative state.

Accordingly, torque is not transmitted by the key. Only a load in the axial direction acts on the key. Consequently, the required mechanical strength of the key in the twisting direction can be made sufficiently small.

In the above-described embodiment, the interlocking unit may be made of an operating lever which may be swung between an OFF position and an ON position. In the OFF position, the operating lever is connected to the key-operated mechanism, and the key-operated mechanism is kept inoperative. In the ON position, the key-operated mechanism is operated.

In the above-described embodiment, a rotary connection portion connected relatively rotatable to the operating lever may be mounted to the sleeve member. A pressing portion engaging the operating lever may be mounted to the plunger member. When the plunger member is moved toward the operative position, the pressing portion transmits a pushing force to the operating lever. When the rotary connection portion and the pressing portion are in the standby position, the operating lever is retained in the OFF position. When the pressing portion is moved from the standby position toward the standby position while the rotary connection portion is left in the standby position, the operating lever undergoes the pushing force from the pressing portion and swings toward the ON position about the rotary connection portion. When the pressing portion reaches the operative position, the lever swings to the ON position.

According to the above embodiments, it is possible for an operator to operate the key-operated mechanism or kept it in an inoperative state simply by inserting a key into the keyway and pushing the key. Therefore, when the key is manipulated by the operator, it is not necessary to transmit torque by the key. Only axial load acts on the key. Consequently, the required mechanical strength of the key in the twisting direction can be made sufficiently small.

In the above embodiments, the key-judging unit may have plural engaging members capable of moving relative to the plunger member in a direction perpendicular to axial direction. Where the authentic key has been inserted in the keyway, all the engaging members come into engagement with engagement portions formed on ends of the authentic key in the direction perpendicular to the axial direction. This disconnects the sleeve member and the plunger member from each other. Where an inauthentic key is inserted into the keyway, at least one of the engaging members comes into abutment with a portion of the inauthentic key other than the engagement portions. The sleeve member is connected to the plunger member such that they move together in the axial direction.

In the above embodiments, the key-judging unit may have: (a) an outer pin hole formed in the sleeve member and extending perpendicularly to the axial direction, the outer pin hole opening into outer space and facing the outer surface of the plunger member; (b) an inner pin hole extending through the plunger member perpendicularly to the axial direction, the inner pin hole registering with the outer pin hole when the sleeve member is in the standby position; (c) an outer pin movably inserted in the outer pin hole and biased inwardly, the outer pin having an inner end portion withdrawably inserted in the inner pin hole; and (d) an inner pin slidably inserted in the inner pin hole. The inner pin has an outer end portion withdrawably inserted into the outer pin hole. When the sleeve member and the plunger member are in the standby position, the inner pin brings the outer end surface into abutment with the inner end surface of the outer pin. Furthermore, the inner pin may be so designed that when an authentic key is inserted in the keyway, the inner pin brings the inner end portion into engagement with the authentic key and places the outer end surface of the inner pin and the inner end surface of the outer pin into the boundary between the outer pin hole and the inner pin hole.

In the above embodiments, the inner pin may be so designed that when an inauthentic key is inserted into the keyway, the inner pin brings the inner end portion into abutment with the inauthentic key. The outer end surface of the inner pin and the inner end surface of the outer pin are offset either inwardly or outwardly from the boundary between the outer pin hole and the inner pin hole.

In the above embodiments, there may be further provided: (a) an outer anchoring hole formed in the inner surface of the case member; (b) a storage hole extending through the sleeve member in a direction perpendicular to the axial direction, the storage hole registering with the outer anchoring hole when the sleeve member is in the standby position; (c) an anchoring member slidably stored in the storage hole and having an outer end portion withdrawably inserted into the outer anchoring hole, the anchoring member further having an inner end portion abutted against the outer surface of the plunger member; and (d) a biasing member disposed in the outer anchoring hole and being capable of resiliently extending and retracting in the direction perpendicular to the axial direction, the biasing member acting to press the inner end portion against the anchoring member when the sleeve member is in the standby position. When an authentic key is inserted in the keyway and the plunger member starts to move from the standby position toward the operative position, the outer end portion of the anchoring member is inserted into the outer anchoring hole against the force of the biasing member by the pushing force from the outer surface of the plunger member. The sleeve member is confined in the standby position.

In the above embodiments, with respect to the inner end portion in the axially cross-sectional shape of the anchoring member, the depthwise dimension taken in the direction perpendicular to the axial direction may be increased from the standby position toward the operative position.

In the above embodiments, there may be further provided: (a) an outer anchoring hole formed in the inner surface of the case member; (b) an inner anchoring hole formed in the outer surface of the plunger member; (c) a storage hole extending through the sleeve member in the direction perpendicular to the axial direction, the storage hole registering with the outer anchoring hole and the inner anchoring hole when the plunger member and the sleeve member are in the standby position; and (d) an anchoring member movably stored in the storage hole and being capable of resiliently extending and retracting in the direction perpendicular to the axial direction. The anchoring member has an outer end portion withdrawably inserted in the outer anchoring hole when the plunger member and the sleeve member are in the standby position. The anchoring member further has an inner end portion withdrawably inserted in the inner anchoring hole. Furthermore, when an authentic key is inserted in the keyway and the plunger member starts to move from the standby position toward the operative position, the anchoring member confines the sleeve member in the standby position. When the inner end portion of the plunger member is disengaged from the inner anchoring hole by the pushing force from the outer surface of the plunger member, if an inauthentic key is inserted in the keyway, and if the sleeve member and the plunger member begin to move from the standby position toward the operative position, the outer end portion of the case member is disengaged from the outer anchoring hole by the pushing force from the inner surface of the case member.

In the above embodiments, with respect to the inner end portion in the axially cross-sectional shape of the anchoring member, the depthwise dimension taken in the direction perpendicular to the axial direction may be increased from the standby position toward the operative position. With respect to the outer end portion, the depthwise dimension taken in the direction perpendicular to the axial direction may be increased from the operative position toward the standby position.

In the above embodiments, the anchoring member may be so designed that the plunger member is anchored and its movement away from the operative position is limited after the plunger member moves from the operative position to the standby position.

A third embodiment of the present invention is a key for use with any one of the locking devices according to the above embodiments. The key has: (a) an inserted plate portion elongated in the axial direction and being capable of being inserted into the keyway; (b) a first engaging end portion formed in one shorter end of the inserted plate portion and having at least one of the aforementioned engagement portions; (c) a second engaging end portion formed in the other shorter end of the inserted plate portion and having at least one of the aforementioned engagement portions; and (d) an engagement surface formed in at least one of surfaces spaced from each other along the thickness of the inserted plate portion, the engagement surface having at least one of the aforementioned engagement portions.

According to the above embodiment, engagement portions can be formed in the axial direction on the first engaging end portion, second engaging end portion, and engagement surface of the key. Therefore, if the number of the installed engagement portions of the key is increased, increase in the total length of the key can be more effectively prevented than a key having only one engagement member in the axial direction.

In the above embodiment, plural reference positions may be set for the first engaging end portion, the second engaging end portion, and the engagement surface. The engagement portions may be formed in a corresponding manner to the reference positions, respectively.

The plural engagement portions can be formed in the same axial position on the key. Furthermore, plural engagement members can be formed in the same axial position on the plunger member. Consequently, if the number of engagement members coming into engagement with the engagement portions of the key is increased, increases in total length of the plunger member of the device and of the key can be more effectively suppressed than the related-art locking device in which only one engagement member is mounted in one axial position on the device and in which only one engagement portion is mounted in one axial position on the key.

As described so far, according to the locking device associated with the present invention, the required mechanical strength of the key can be reduced. Furthermore, if the number of engagement members coming into engagement with the engagement portions of the key is increased, increases in total length of the device and key can be more effectively suppressed than heretofore.

In addition, according to the key associated with the present invention, when the key is inserted into the keyway, if the number of installed engagement portions which are engaged by the engagement members of the locking device is increased, increases in the total length can be effectively suppressed.

BRIEF DESCRIPTION OF THE DRAWINGS

Embodiments of the present invention will be described in detail based on the following figures, wherein.

DETAILED DESCRIPTION OF THE INVENTION

Locking devices associated with exemplary embodiments of the present invention and keys adapted for use with the locking devices are hereinafter described with reference to the drawings.

First Embodiment

Structure of the Embodiment

Figures 1A, 1B, 1C:
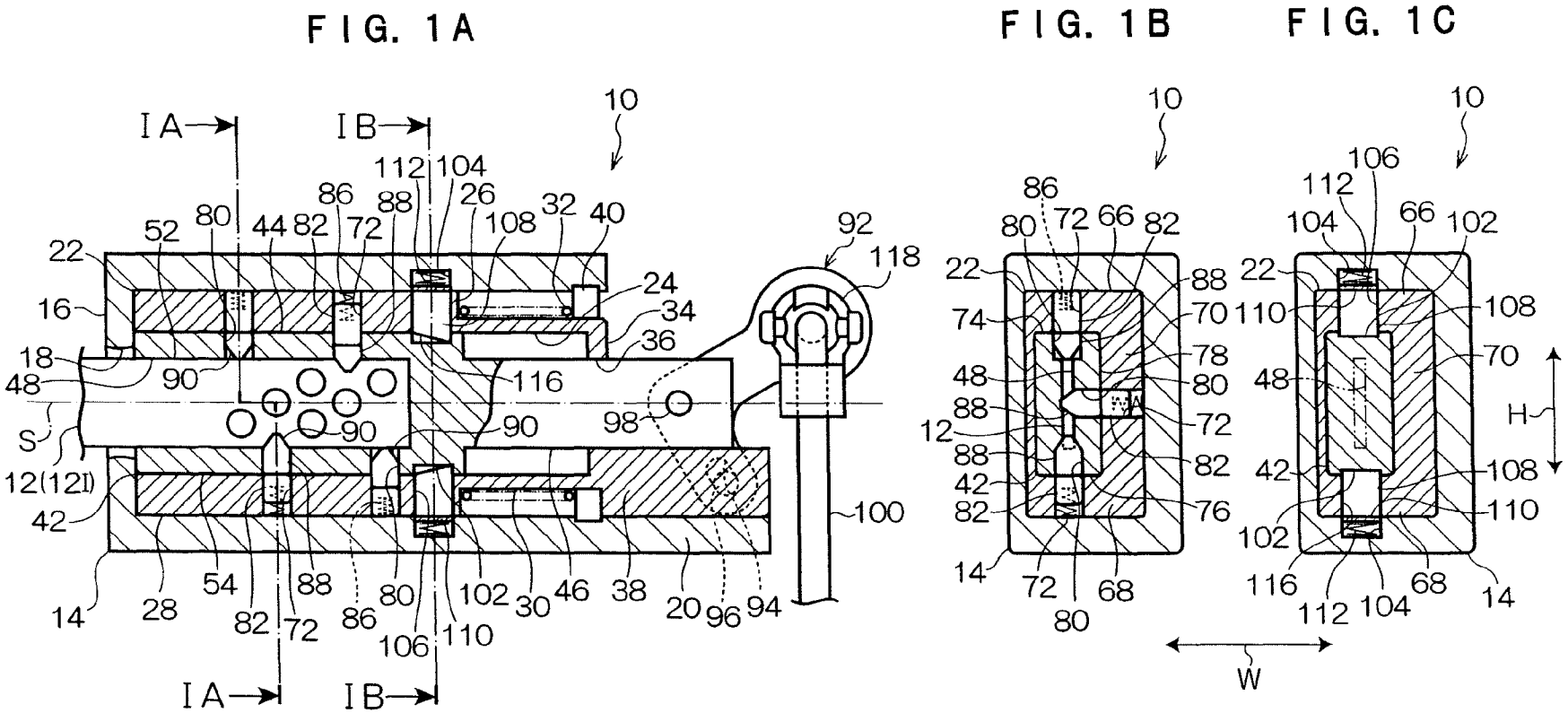
FIG. 1A is a side elevation in cross section showing the structure of a locking device associated with a first embodiment of the present invention.
FIG. 1B is a cross-sectional view of the locking device, taken on line IA-IA of FIG. 1A.
FIG. 1C is a cross-sectional view of the locking device, taken on line IB-IB of FIG. 1A.

A locking device associated with a first embodiment of the present invention is shown in FIGS. 1A-1C and 2A-2B. One example of key for use with the locking device associated with the present embodiment is shown in FIG. 3. The axis of the device is indicated by S (FIG. 1A). In the following description, a direction taken along the axis S is indicated as the axial direction of the device. The locking device, generally indicated by reference numeral 10, associated with the present embodiment is mounted as a part of a locking mechanism for locking and unlocking an open/close member that can be opened and closed such as an automotive door or a cover body (such as a trunk hood or glove box). The locking device is used by an operator to unlock the locking mechanism in locked state with the key 12.

As shown in FIGS. 1A-1C, the locking device 10 has a box-like case member 14 as the housing of the device. The case member 14 is elongated in the axial direction and has a peripheral wall portion whose cross-sectional shape taken in a direction perpendicular to the axial direction is similar to a rectangle whose longitudinal direction is in the heightwise direction indicated by the arrows H. The case member 14 has a cover portion 16 that closes off the opening at the front end side (left side in FIG. 1A) in the axial direction. The cover portion 16 is centrally provided with an opening portion 18 permitting passage of the key 12. A lever guide 20 in the form of a flat plate extends axially along a rear lower end portion of the case member 14 and is formed integrally with the case member 14.

The case member 14 of the locking device 10 associated with the present embodiment is disposed in a door, vehicular body, or the like in which the locking mechanism is housed. Under this condition, the case member 14 is mounted to the door or vehicular body such that the opening portion 18 faces outward from the housing.

The locking device 10 has a box-shaped sleeve member 22 disposed inside the case member 14. The sleeve member 22 is elongated in the axial direction and has a peripheral wall portion whose cross-sectional shape taken in the direction perpendicular to the axial direction is similar to a rectangle whose longitudinal direction is in the heightwise direction. The sleeve member 22 is inserted inside the case member 14 and supported by the case member 14 so as to be slidable in the axial direction. The sleeve member 22 can slide between a standby position shown in FIG. 1A and an operative position shown in FIG. 2A. In the standby position, the front end surface of the sleeve member 22 is in abutment with the inside of the cover portion 16. When the sleeve member slides a given operative stroke D (see FIG. 2A) rearwardly from the standby position, the operative position is reached.

The sleeve member 22 is provided with in its inside a plunger accommodation chamber 24 that is a space extending axially through the sleeve member. A step portion 26 is formed in an axially intermediate portion on the outer surface of the sleeve member 22. A sleeve body 28 is formed at the front end side with respect to the step portion 26. A spring-holding portion 30 is formed on the rear end side. The sleeve body 28 is slidably and fitly inserted in the case member 14 such that the outer surface touches the inner surface of the case member 14. The dimensions of the spring-holding portion 30 which are taken in the direction of the height (in the direction of the arrows H in FIG. 1C) and in the direction of the width (in the direction of the arrows W in FIGS. 1B and 1C) are smaller than the dimensions of the sleeve body 28. A coil spring 32 having a winding portion is fitted over the sleeve-holding portion, the winding portion being bent like a rectangular form.

As shown in FIG. 1A, a cover portion 34 is formed in the sleeve member 22 to close off the opening at the rear end side. A rod guide hole 36 is formed around the center of the cover portion 34 and extends axially through the cover portion. A slide lever 38 extending axially toward the rear end from the lower end portion of the cover portion 34 is formed integrally with the sleeve member 22. The lower end surface of the slide lever 38 is slidably abutted against the upper end surface of the lever guide 20 in the case member 14.

The locking device 10 further includes a seat-receiving member 40 disposed between the rear end of the inner surface of the case member 14 and the outer surface of the spring-holding portion 30. The seat-receiving member 40 assumes an elongated rectangular column. The outer surface of the seat-receiving member 40 is firmly held to the inner surface of the case member 14 and extends peripherally. The inner surface is slidably abutted against the outer surface of the spring-holding portion 30. In the locking device 10, a coil spring 32 is interposed and compressed between the step portion 26 of the sleeve member 22 and seat-receiving member 40. Consequently, the coil spring 32 always biases the sleeve member 22 toward the operative position (see FIG. 1A).

As shown in FIGS. 1A-1C, the locking device 10 has a plunger member 42 disposed in the plunger accommodation chamber 24 of the sleeve member 22. The plunger member 42 is shaped like a rectangular column that is elongated in the axial direction. The plunger member 42 has a plunger body 44 fitly inserted in the plunger accommodation chamber 24, the plunger body 44 being located on the axially front end side. A plunger rod 46 protrudes axially from the center of the rear end surface of the plunger body 44. The plunger body 44 is slidably and fitly inserted in the plunger accommodation chamber 24 of the plunger member 42. The plunger body 44 is supported so as to be movable between the given standby position (see FIG. 1A) and the given operative position (FIG. 2B) by the case member 14.

In the standby position, the front end surface of the plunger member 42 is abutted against the inside of the cover portion 16. When the plunger member 42 moves the given operative stroke D (see FIG. 2B) rearwardly from the standby position, the operative position is reached. As described previously, in the locking device 10, the sleeve member 22 is supported by the case member 14 so as to be movable between the standby position and the operative position.

As shown in FIG. 1A, a rear end portion of the plunger rod 46 of the plunger member 42 protrudes outwardly of the sleeve member 22 through the rod guide hole 36. The lower end surface of the portion of the rod 46 protruding from the rod guide hole 36 is slidably abutted against the upper end surface of the slide lever 38 in the sleeve member 22. The plunger body 44 is centrally provided with an axially extending keyway 48. The keyway 48 extends from the front end surface of the plunger body 44 to the rear end. As shown in FIG. 1B, the cross-sectional shape of the keyway is similar to a slit elongated along the height of the device. This cross-sectional shape of the keyway 48 conforms to the shape of the key 12 (see FIG. 3) corresponding with the locking device 10 associated with the present embodiment. The key 12 can be inserted into and withdrawn from the keyway 48.

As shown in FIG. 3, the portion (inserted plate portion) of the key 12 which is inserted into the keyway 48 is shaped like a flat elongated plate. For example, the inserted plate portion is made of metal, resin, paper, or composite material thereof. The key 12 has an insertion guide portion 50 in its front end portion. The wall thickness of the guide portion 50 decreases from the base end side toward the front end side in a slopewise manner. The key 12 has two end surfaces spaced from each other perpendicularly to the axial direction. An upper engaging end 52 and a lower engaging end 54 are formed on these two end surfaces, respectively. An engagement surface 56 is formed on one end surface provided in the width direction of the key 12. The operator places the key 12 in a posture where the upper engaging end 52 faces upward along the height of the device. Under this condition, the key is inserted into the keyway 48.

Five engagement positions PE1-PE5 are set on each of the upper engaging end 52 and lower engaging end 54 of the key 12 and spaced from each other longitudinally of the key 12, i.e., axial direction of the device. V-shaped engagement portions 58 are selectively formed in the engagement positions PE1-PE5. Alternatively, a flat engagement portion 60 is formed by not machining the geometries of the upper engaging end 52 and lower engaging end 54.

Five reference lines L1-L5 which are spaced from each other in the longitudinal direction of the key 12 are set on the engagement surface 56. Three reference lines S1-S3 which are spaced from each other in the direction perpendicular to the longitudinal direction of the key 12 are set on the engagement surface 56. The positions at which the reference lines L1-L5 and reference lines S1-S3 intersect each other on the engagement surface 56 are defined as engagement positions. Engagement portions 62, each of which is made of a circular hole penetrating through the thickness of the key, are selectively formed in the engagement positions. Alternatively, a flat engagement portion 64 is formed by not machining the geometry of the engagement surface 56.

The key 12 can be inserted into and withdrawn from the keyway 48 as long as the key complies with the structure for the locking device 10 associated with the present embodiment. The key 12 can be an authentic key 12R having the engagement portions 58 and 60 correctly formed at the positions PE's and the engagement portions 62 and 64 correctly formed at the positions on the engagement surface 56 according to the settings of the key-judging unit (described later) of the key device 10. Also, the key 12 can be an inauthentic key 12I which is not coincident in shape with the authentic key 12R or which may be a key substitute such as a screwdriver that can be inserted into the keyway 48 instead of the key 12.

As shown in FIGS. 1A and 1B, the sleeve member 22 has a top plate portion 66, a bottom plate portion 68, and one side plate portion 70 each of which is provided with at least one circular outer pin hole 72 penetrating through the respective portions perpendicularly to the axial direction. In the top plate portion 66, the outer pin holes 72 are disposed in locations (in the present embodiment, locations corresponding to PE2 and PE5) corresponding to at least one selected from the engagement positions PE1-PE5 on the key 12. In the bottom plate portion 68, the outer pin holes 72 are disposed in locations (in the present embodiment, locations corresponding to PE1 and PE4) corresponding to at least one selected from the engagement positions PE1-PE5 on the key 12. In the side plate portion 70, the outer pin holes 72 are disposed in locations (in the present embodiment, engagement positions corresponding to L4 and S2) corresponding to at least one selected from the 15 engagement positions on the key 12.

In the present embodiment, the sleeve member 22 is assumed to have only five outer pin holes 72 in total to simplify the description of the locking device 10. In the top plate portion 66 and bottom plate portion 68, four outer pin holes 72 at maximum can be disposed to cope with all the engagement positions PE1-PE5. In the side plate portion 70, five outer pin holes 72 at maximum can be disposed to cope with the reference lines L1-L5.

As shown in FIGS. 1A and 1B, the plunger member 42 has a top plate portion 74, a bottom plate portion 76, and one side plate portion 78 each of which is provided with one or more circular inner pin holes 80 penetrating through the each plate portion perpendicularly to the axial direction. In each of the top plate portion 74 and bottom plate portion 76, plural (in the present embodiment, two) inner pin holes 80 are formed. One inner pin hole 80 is formed in the side plate portion 78. When the sleeve member 22 and plunger member 42 are in the standby position, the opening ends of the inner pin holes 80 on the outer circumference of the plunger member 42 register with the opening ends of the outer pin holes 72 on the inner circumference of the sleeve member 22. The inside diameter of each outer pin hole 72 is equal to the inside diameter of each inner pin hole 80. The each inner pin hole 80 opens to the keyway 48 at the inner circumference of the plunger member 42.

The outer pins 82 are slidably inserted in the outer pin holes 72 of the sleeve member 22. Each outer pin 82 is shaped like a cylinder whose thickness is substantially uniform over the whole length. The length is substantially equal to or smaller than the length of each outer pin hole 72 taken perpendicularly to the axial direction. Outward movement of each outer pin 82 is limited by the inner surface of the case member 14. When the sleeve member 22 and plunger member 42 are in the standby position, inward movement of each outer pin 82 is limited by inner pins 88 inserted in the inner pin holes 80 described later.

Each outer pin 82 is provided with a circular concave holder hole (not shown) in the outer end surface (rear end surface). A coil spring 86 is received in the holder hole. The coil spring 86 is compressed between the bottom surface of the holder hole and the inner surface of the case member 14 and always biases the outer pin hole 72 toward inner circumference direction of the sleeve member 22.

In the locking device 10, the inner pins 88 are slidably inserted in the inner pin holes 80 formed in the plunger member 42. Each inner pin 88 has a rear end portion shaped like a cylinder whose thickness is uniform. Each inner pin 88 has a front end portion provided with a conic key engagement portion 90. The length of the inner pin 88 is substantially equal to or greater than the length of each inner pin hole 80 taken perpendicularly to the axial direction. As shown in FIG. 1, each inner pin 88 has an outer end portion (rear end portion) that can be inserted into and withdrawn from the corresponding outer pin hole 72. The key engagement portion 90 can be inserted into and withdrawn from the keyway 48.

As shown in FIGS. 1A and 1B, when the sleeve member 22 and plunger member 42 are in the standby position, the outer end surface (rear end surface) of each inner pin 88 abuts against the front end surface of the corresponding outer pin 82 to limit inward movement of the outer pin 82.

When the key 12 which might be the authentic key 12R is inserted into the keyway 48, the inner pins 88 disposed in the top plate portion 74 of the plunger member 42 bring the key engagement portions 90 into engagement with the engagement portions 58 and 60 formed in the upper engaging end 52 of the key 12. When the key 12 which might be the authentic key 12R is inserted into the keyway 48, the inner pins 88 disposed in the bottom plate portion 76 of the plunger member 42 bring the key engagement portions 90 into engagement with the engagement portions 58 and 60 formed in the lower engaging end 54 of the key 12.

Where the key engagement portions 90 are engaged in the engagement portions 58, each shaped like a recessed groove, the inner pins 88 insert the key engagement portions 90 into the engagement portions 58. Where the key engagement portions 90 are engaged in the planar engagement portion 60, the inner pins 88 bring the front ends of the key engagement portions 90 into abutment with the engagement portions 60. Thus, the key engagement portions are placed in positions corresponding to the engagement portions 58 and 60, respectively, along the height of the device (i.e., perpendicularly to the axial direction).

When the key 12 which might be the authentic key 12R is inserted into the keyway 48, the inner pins 88 disposed in the side plate portion 78 of the plunger member 42 bring the key engagement portions 90 into engagement with the engagement portions 62 and 64 formed in the engagement surface 56 of the key 12. Where the key engagement portions 90 are engaged in the engagement portions 62, each in the form of a circular hole, the inner pins 88 insert the key engagement portions 90 into the engagement portions 62. Where the key engagement portions 90 are engaged in the planar engagement portion 64, the inner pins 88 bring the front ends of the key engagement portions 90 into abutment with the engagement portions 64, thus placing the key engagement portions in positions corresponding to the engagement portions 62 and 64, respectively, across the width of the device (i.e., perpendicularly to the axial direction).

The pitch between a pair of outer pin holes 72 in the sleeve member 22 adjacent to each other in the axial direction and the pitch between a pair of inner pin holes 80 in the plunger member 42 adjacent to each other in the axial direction are greater than the strokes D of the sleeve member 22 and plunger member 42, respectively, taken in the axial direction.

Figure 2A:
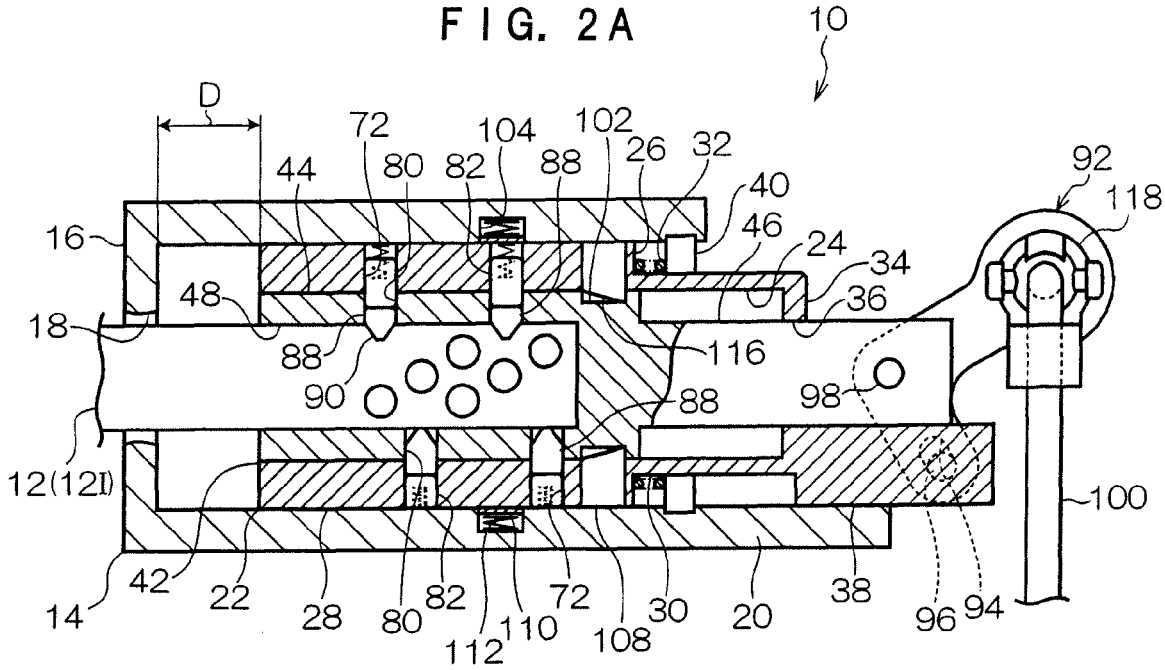
FIG. 2A is a side elevation in cross section of a locking device associated with the first embodiment of the present invention, and in which an inauthentic key has been inserted in the keyway and a sleeve member and a plunger member together have moved to the operative position.
Figure 2B:
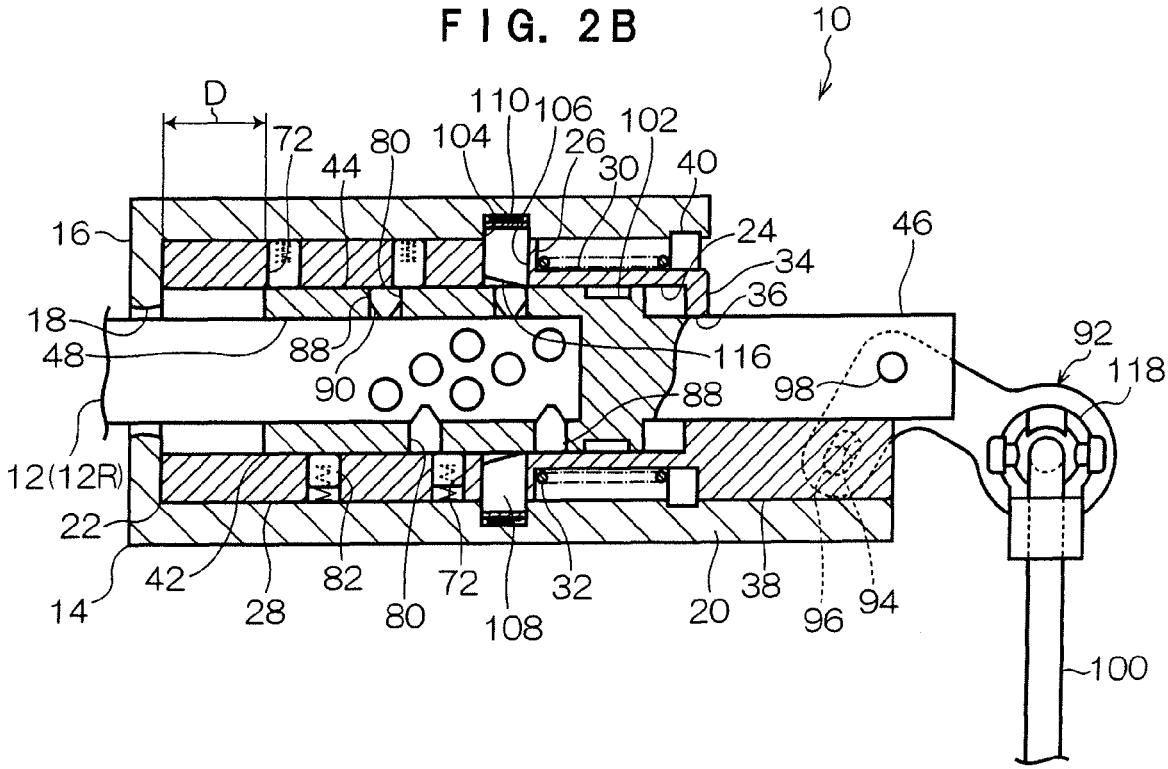
FIG. 2B is a side elevation similar to FIG. 2A, but in which an authentic key has been inserted in the keyway and only the plunger member has moved to the operative position.
Figure 3:
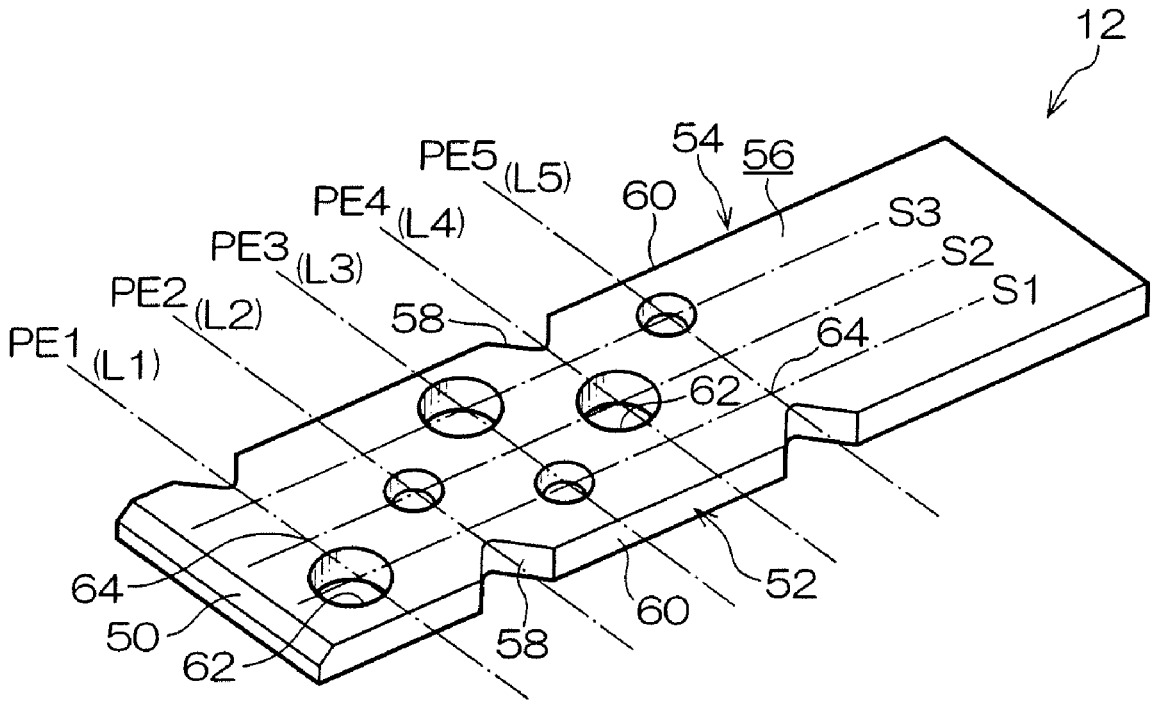
FIG. 3 is a perspective view of one example of key for use with the locking device shown in FIGS. 1A-1C.

FIGS. 1A and 2A show a case in which the key 12 different in shape with the authentic key 12R is inserted in the keyway 48 of the plunger member 42. FIG. 2B shows a case in which the authentic key 12R is inserted in the keyway 48 of the plunger member 42.

When the key 12 is inserted into the keyway 48 of the locking device 10, the inner pins 88 bring the key engagement portions 90 into engagement with any ones of the engagement portions 58, 60 and engagement portions 62, 64 of the key 12. The key engagement portions are moved perpendicularly to the axial direction into positions corresponding to the engagement portions 58, 60, 62, 64 and placed in position there. Where the key 12 inserted in the keyway 48 is the authentic key 12R, all the inner pins 88 cause the rear end surfaces to be placed at the boundaries between the outer pin holes 72 and inner pin holes 80 and, at the same time, cause the front end surfaces of the outer pins 82 to be placed at the boundaries between the outer pin holes 72 and the inner pin holes 80. As a result, the plunger member 42 is disconnected from the sleeve member 22 in the axial direction. As shown in FIG. 2B, the plunger member can be moved to the operative position while leaving the sleeve member 22 in the standby position.

Where the key 12 inserted in the keyway 48 is different in shape with the authentic key 12R, the rear end surface of at least one of the plural inner pins 88 is offset inwardly or outwardly from the boundary between the corresponding outer pin hole 72 and the corresponding inner pin hole 80 as shown in FIG. 1A. The front end surface of the outer pin 82 is offset inwardly or outwardly from the boundary between the outer pin hole 72 and the inner pin hole 80. Consequently, the plunger member 42 is connected with the sleeve member 22 in the axial direction by one of the outer pin 82 and inner pin 88. As shown in FIG. 2A, the plunger member moves always together with the sleeve member 22 between the standby position and the operative position.

In the locking device 10 associated with the present embodiment, a key-judging unit associated with the present invention is constituted by the outer pin holes 72 in the sleeve member 22, the inner pin holes 80 in the plunger member 42, the outer pins 82 inserted in the outer pin holes 72, the coil spring 86 biasing the outer pins 82 inwardly, and the inner pins 88 inserted in the inner pin holes 80.

As shown in FIG. 1A, the locking device 10 has an operating lever 92 that is connected to the rear end portion of the slide lever 38 and connected to the rear end portion of the plunger rod 46. The lever 92 is shaped like an elongated flat plate and bent as V shape in the longitudinal direction. The lever 92 has a base end portion (lower end portion as viewed in FIG. 1A) provided with an elliptical connection hole 94 extending longitudinally of the lever. A cylindrical connecting shaft 96 whose axis is along the width of the device is mounted to the rear end portion of the slide lever 38. The connecting shaft 96 is rotatably inserted in the connecting hole 94 in the operating lever 92 and can move within the connecting hole 94 longitudinally of the hole 94. The base end portion of the lever 92 is swingably connected to the rear end portion of the slide lever 38 via the connecting shaft 96.

A cylindrical pushing shaft 98 whose axis is along the width of the device is mounted to the rear end portion of the plunger rod 46. The shaft 98 penetrates through the operating lever 92 in a location close to its longitudinal center, and is connected relatively rotatable to the operating lever 92. The lever 92 has a distal end portion extending from the rear end portion of the plunger rod 46 to its backward direction along the axial direction. A cylindrical bearing member 118 is mounted to the distal end portion of the lever 92. An upper end portion of a connecting rod 100 is connected relatively rotatable to the distal end portion of the lever 92 via the bearing member 118, the rod 100 being shaped like an elongated round rod. The connecting rod 100 extends along the height direction of the device and has a lower end portion connected to a body (not shown) portion of a locking mechanism. The operating lever 92 can be swung between a given locked position (see FIG. 1A) and a given unlocked position (see FIG. 2B) with respect to the connecting shaft 96 of the slide lever 38.

As shown in FIG. 1A, in the locking device 10, when the sleeve member 22 and plunger member 42 are in the standby position, the positions of the connecting shaft 96 and pushing shaft 98 taken in the axial direction are so set that the operating lever 92 is held in the locked position.

As shown in FIG. 2B, when the sleeve member 22 of the locking device 10 is in the standby position, if only the plunger member 42 moves from the standby position to the operative position, the pushing shaft 98 moves in the axial direction reawardly with respect to the connecting shaft 96. An axial pushing force from the plunger member 42 acts on the operating lever 92 via the pushing shaft 98. Consequently, the operating lever 92 swings from the locked position to the unlocked position while having a rotation center at the connecting shaft 96. When the plunger member 42 reaches the operative position, the operating lever 92 swings to the unlocked position.

When swings from the locked position to the unlocked position, the operating lever 92 moves the connecting rod 100 downward and transmits a pushing force (manipulative force) exerted along the height of the device to the body portion of the locking mechanism via the connecting rod 100. The body portion of the locking mechanism undergoing the manipulative force is switched from locked state to unlocked state. The open/close member such as a door, trunk hood, glove box, or other cover body which has been locked by the locking mechanism can be made openable.

When the opened open/close member is again closed, the body portion of the locking member transmits a pushing force (restoring force) to the operating lever 92 via the connecting rod 100, biasing the operating lever 92 toward the locked position from the unlocked position. The biasing force from the body portion of the locking mechanism restores the operating lever 92 to the locked position from the unlocked position and restores the plunger member 42 to the standby position from the operative position.

As shown in FIG. 2A, in the locking device 10, when the sleeve member 22 and plunger member 42 together move from the standby position to the operative position, the operating lever 92 is held in the locked position, because the positional relationship in the axial direction between the pushing shaft 98 and the connecting shaft 96 does not vary. Accordingly, if the sleeve member 22 and plunger member 42 move together from the standby position to the operative position, the body portion of the locking mechanism is not unlocked but is kept locked. Under this condition, if the operator ceases to push the key 12 (in this case, key 12I different in shape with the authentic key 12R), the sleeve member 22 and plunger member 42 in the operative position are restored to the standby position by the restoring force of the coil spring 32.

As shown in FIGS. 1A and 1C, in the locking device 10, inner anchoring concave holes 102 are formed in the upper and lower sides, respectively, of the outer surface of the plunger body 44. Outer anchoring concave holes 104 are formed in the upper and lower sides, respectively, of the inner surface of the case member 14. The inner anchoring holes 102 are located at the rear side of the inner pin holes 80 in the plunger body 44 in the axial direction. When the plunger member 42 is in the standby position, the outer anchoring holes 104 are in registry with the inner anchoring holes 102 axially and widthwise of the device.

In the locking device 10, the sleeve member 22 is provided with a storage hole 106 which penetrates through the sleeve member perpendicularly to the axial direction. When the sleeve member 22 and plunger member 42 are in the standby position, the storage hole 106 is in registry with the outer anchoring hole 104 and inner anchoring hole 102 both axially and widthwise of the device. The outer anchoring hole 104, inner anchoring hole 102, and storage hole 106 are identical in cross-sectional shape taken in the axial direction.

As shown in FIG. 1A, in the locking device 10, an anchoring bar 108 shaped like a rectangular column is stored in the storage hole 106 so as to be slidable perpendicularly to the axial direction. A biasing member composed of a biasing plate 110 and a spring 112 is inserted in the outer anchoring hole 104. The anchoring bar 108 has an outer end surface (rear end surface) parallel to the axial direction. The bar also has a front end surface which is formed as a planar cam surface 116 slanted outwardly from the rear side toward the front side in the axial direction.

When the sleeve member 22 is in the standby position, the rear end surface of the anchoring bar 108 is pressed against the front end surface of the plate-like biasing plate 110, while the rear end portion can be inserted into and withdrawn from the outer anchoring hole 104. When the sleeve member 22 and plunger member 42 are in the same position in the axial direction, the front end portion of the bar 108 is withdrawably inserted in the inner anchoring hole 102 and pressed against the bottom surface of the inner anchoring hole 102. The biasing plate 110 is slidably inserted in the outer anchoring hole 104. The spring 112 is disposed and compressed between the rear end surface of the biasing plate 110 and the bottom surface of the outer anchoring hole 104.

In the locking device 10, when the authentic key 12R is inserted in the keyway 48 and the plunger member 42 starts to move from the standby position toward the operative position, the cam surface 116 of the anchoring bar 108 receives a pushing force from the outer surface of the plunger member 42, the pushing force acting perpendicularly to the axial direction. The anchoring bar 108 is pushed outward against the biasing force of the spring 112. As a result, as shown in FIG. 2B, the rear end portion of the anchoring bar 108 is inserted into the outer anchoring hole 104. At this time, the bar 108 is stayed at both the outer anchoring hole 104 and storage hole 106 while positioned at the boundary between the outer anchoring hole 104 and storage hole 106, and thus confines the sleeve member 22 in the standby position. Furthermore, when the plunger member 42 returns to the standby position from the operative position, the anchoring bar 108 is moved inward by the biasing force of the spring 112. The front end portion is inserted into the inner anchoring hole 102.

In the locking device 10, when the key 12I different in shape with the authentic key 12R is inserted in the keyway 48 and the sleeve member 22 is connected to the plunger member 42 by the outer pin 82 or inner pin 88, as well as the anchoring bar 108 held in the storage hole 106 and inner anchoring hole 102, the key is moved together with the sleeve member 22 and plunger member 42 in the axial direction.

Operation of the Embodiment

The operation of the locking device 10 associated with the present embodiment is next described.

In the locking device 10, when the operator inserts the authentic key 12R into the keyway 48 and the plunger member 42 is pushed toward the operative position via the authentic key 12R, only the plunger member 42 starts to move toward the operative position from the standby position while the sleeve member 22 is confined by the anchoring bar 108. The operating lever 92 in the locked position is linked with the movement of the plunger member 42 toward the operative position and swings toward the unlocked position. When the plunger member 42 reaches the operative position, the operating lever 92 swings to the unlocked position, thus switching the state of the body portion of the locking mechanism from locked state to unlocked state. In consequence, the open/close member locked by the locking mechanism is unlocked and made openable. Then, if the opened open/close member is again closed, a restoring force is transmitted to the operating lever 92 from the body portion of the locking mechanism via the connecting rod 100. As a result, the operating lever 92 in the unlocked position is restored to the locked position. Also, the plunger member 42 in the operative position returns to the standby position.

Furthermore, in the locking device 10, if the inauthentic key 12I made either of a key 12 other than the authentic key 12R or of a key substitute is inserted into the keyway 48 by the operator, the sleeve member 22 and plunger member 42 are coupled together by the outer pins 82 or inner pins 88. If the plunger member 42 is thereby pushed toward the operative position by the inauthentic key 12I, the plunger member 42 and sleeve member 22 together start to move from the standby position toward the operative position. In the locking device 10, if the plunger member 42 and sleeve member 22 reach the operative position after being coupled together, the operating lever 92 in the locked position is prevented from being swung. Therefore, the body portion of the locking mechanism is kept locked. Then, if the operator ceases to push the inauthentic key 12I, the restoring force from the body portion of the locking mechanism and the restoring force of the coil spring 32 restore the plunger member 42 and sleeve member 22 to the standby position.

Accordingly, in the locking device 10 associated with the present embodiment, in a case where the key 12 inserted into the keyway 48 by the operator is the authentic key 12R and the key is pushed in the axial direction of the device, the body portion of the locking mechanism is unlocked. Where the key 12 is an inauthentic key 12I, the body portion of the locking mechanism can be kept locked. Therefore, when the key is manipulated by the operator, it is not necessary to transmit torque by the key 12, unlike the rotary locking device in which the key-manipulated mechanism functions by rotating the key after it is inserted in the keyway. Substantially, only axial load acts on the key 12. Consequently, the required mechanical strength of the key 12 in the twisting direction can be made sufficiently small.

As a result, according to the locking device 10 associated with the present embodiment, it is not always necessary to fabricate the key 12 from a high-strength material such as iron, stainless steel, or the like. For example, the key 12 can be fabricated from a low-strength material that has not been conventionally usable as a molding material such as plastic, waterproof paper, aluminum alloy, or magnesium alloy. In addition, if the wall thickness of the key 12 is made much smaller than a conventional key, deformation or other problem does not take place.

Additionally, in the locking device 10, if the inauthentic key 12I that might be a screwdriver is inserted into the keyway 48, and if the inauthentic key 12I is pushed toward the rear end of the device in the axial direction, the plunger member 42 and sleeve member 22 move together simply from the standby position to the operative position. The body portion of the locking mechanism is prevented from being unlocked. Furthermore, no excessive force is applied to the case member 14, sleeve member 22, plunger member 42, or components disposed on them (such as outer pins 82, inner pins 88, or anchoring bar 108). Hence, these components are prevented from being damaged. When the key 12 is not inserted in the keyway 48, the plunger member 42 and sleeve member 22 are connected together by the outer pins 82 or inner pins 88. Therefore, under this condition, if the plunger member 42 is pushed and moved from the standby position to the operative position, the operating lever 92 is prevented from being swung from the locked position. The body portion of the locking mechanism is kept in the locked state.

Additionally, in the locking device 10, when the connecting shaft 96 of the sleeve member 22 and the pushing shaft 98 of the plunger member 42 are in the standby position, the operating lever 92 is held in the locked position. When the pushing shaft 98 of the plunger member 42 is moved from the standby position toward the operative position while the connecting shaft 96 of the sleeve body 28 is confined in the standby position, the operating lever 92 receives the pushing force from the pushing shaft 98 and swings around the connecting shaft 96 toward the unlocked position. When the pushing shaft 98 reaches the operative position, the lever swings to the unlocked position.

Thus, when the operator pushes the plunger member 42 via the authentic key 12R inserted in the keyway 48 to move the plunger member 42 to the operative position, it is assured that the operating lever 92 swings from the locked position to the unlocked position. The body portion of the locking mechanism can be unlocked.

If the operator inserts the inauthentic key 12I that is either a key 12 other than the authentic key 12R or a key substitute into the keyway 48, and if the plunger member 42 is pushed via the inauthentic key 12I, the operating lever 92 in the locked position does not swing toward the unlocked position, thus the body portion of the locking mechanism can be maintained locked reliably. At this time, if an excessive force is applied to the inauthentic key 12I by the operator, the force from the operator is not transmitted to the lever 92. Therefore, even when the inauthentic key 12I is inserted, damage to the lever 92 can be prevented with certainty.

Further, in the locking device 10, when the key 12 is inserted into the keyway 48, the key engagement portions 90 of the plural inner pins 88 come into engagement with the engagement portions 58, 60, 62, and 64 of the upper engaging end 52, lower engaging end 54, and engagement surface 56 of the key 12 and move into positions corresponding to the engagement portions 58, 60, 62, and 64 perpendicularly to the axial direction.

At this time, where the authentic key 12R is inserted into the keyway 48 and all the inner pins 88 move to positions corresponding to their normal engagement portions 58, 60, 62, and 64, the inner pins 88 and outer pins 82 disconnect the sleeve member 22 from the plunger member 42. Where the inauthentic key 12I is inserted into the keyway 48 and at least one of the inner pins 88 does not move to the corresponding positions of the normal engagement portions 58, 60, 62, and 64, the inner pins 88 and outer pins 82 connect the sleeve member 22 with the plunger member 42. Consequently, plural (in the present embodiment, three at maximum) engagement portions 58, 60, 62, and 64 can be mounted at the same axial position on the key 12. Furthermore, plural (in the present embodiment, three at maximum) inner pins 88 can be mounted at the same axial position on the plunger member 42.

As a result, in contrasut with the related-art locking device where only one engagement member is mounted in one axial position on the device and only one engagement portion is provided in one axial position on the key, although the number of installed engagement portions 58, 60, 62, and 64 on the key 12 and the number of inner pins 88 engaging the engagement portions 58, 60, 62, and 64 are increased, increases in the total lengths of the plunger member 42 and key 12 can be effectively suppressed.

In the key 12 associated with the present embodiment, the engagement portions 62 and 64 are formed on only one of the surfaces in the thickness direction of the key 12. This one surface is used as the engagement surface 56. Where the wall thickness of the key 12 is twice or more greater than the amount of insertion of the inner pins 88 (key engagement portion 90) into the engagement portions 62 and 64, engagement portions 62 and 64 may also be formed on the other surface of the key 12. The other surface may be used as the engagement surface 56. In this case, the outer pin holes 72 are formed in the side plate portion on the opposite side of the side plate portion 70 of the sleeve member 22. The outer pins 82 are arranged in the outer pin holes 72. The inner pin holes 80 are formed in the side plate portion on the opposite side of the side plate portion 78 of the plunger member 42. The inner pins 88 are arranged in the inner pin holes 80.

Additionally, in the locking device 10, when the authentic key 12R is inserted into the keyway 48 and the plunger member 42 starts to move from the standby position toward the operative position, the rear end portion of the anchoring bar 108 is inserted into the outer anchoring hole 104 by the pushing force from the outer surface of the plunger member 42 against the biasing force of the spring 112, thus confining the sleeve member 22 with the case member 14. Accordingly, when the plunger member 42 moves from the standby position to the operative position, it is assured that the sleeve member 22 is held in the standby position. Therefore, it is prevented that the sleeve member 22 is moved from the standby position toward the operative position due to frictional force from the plunger member 42. The operating lever 92 can be swung from the locked position to the unlocked position with certainty.

Second Embodiment

Structure of the Embodiment

A locking device associated with a second embodiment of the present invention is shown in FIGS. 4A-4C and 5A-5B. The locking device associated with the present embodiment is generally indicated by reference numeral 120. Those components of the locking device 120 which are identical with the counterparts of the locking device 10 associated with the first embodiment are indicated by the same reference numerals as used in the description of the first embodiment and thus their description will be omitted.

The locking device 120 associated with the present embodiment is similar to the locking device 10 in the first embodiment except for anchoring bar 122 stored in storage hole 106 in the sleeve member 22, outer anchoring holes 124 formed in the inner surface of the case member 14, and inner anchoring holes 126 formed in the plunger member 42.

Figures 4A, 4B, 4C:
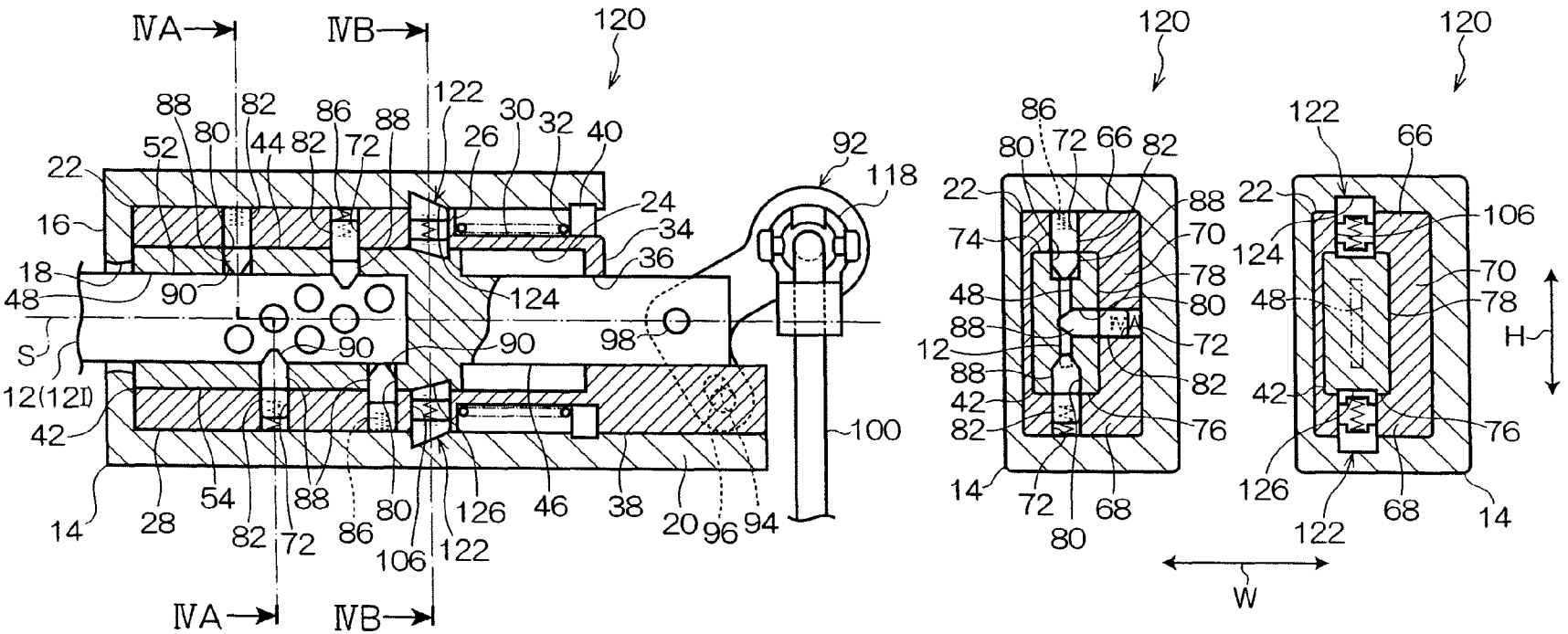
FIG. 4A is a side elevation in cross section showing the structure of a locking device associated with a second embodiment of the invention.
FIG. 4B is a cross-sectional view of the locking device, taken on line IVA-IVA of FIG. 4A.
FIG. 4C is a cross-sectional view of the locking device, taken on line IVB-IVB of FIG. 4A.

As shown in FIGS. 4A and 4C, the locking device 120 includes a plunger body 44. On an outer surcumference of the plunger body 44, concave inner anchoring holes 126 are formed in the upper side and lower side thereof, respectively. Concave outer anchoring holes 124 are formed in the upper side and lower side, respectively, of the inner surface of the case member 14. The inner anchoring holes 126 are located at the rear side in the axial direction with respect to the inner pin holes 80 at the plunger body 44. The outer anchoring holes 124 are in registry with the inner anchoring holes 102 axially and widthwise of the device when the plunger member 42 is in the standby position.

Figure 6A:
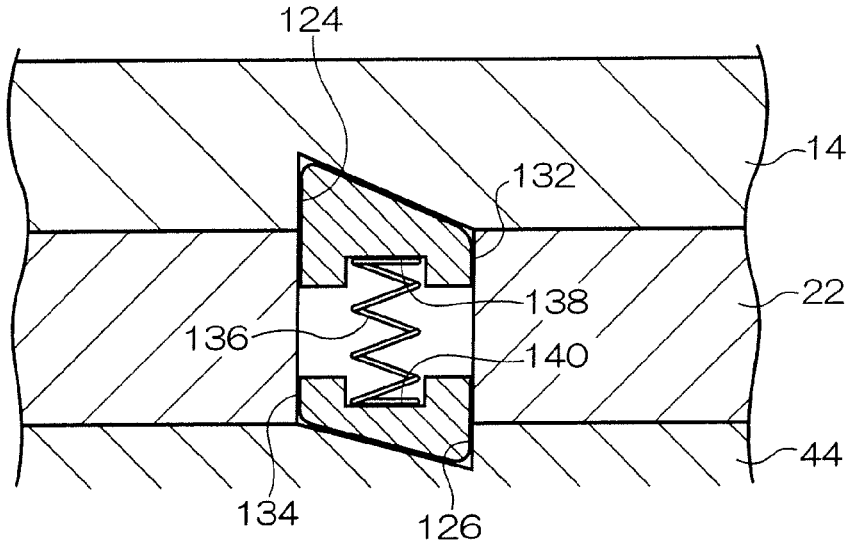
FIGS. 6A-6C are enlarged cross sections of portions of the locking device associated with the second embodiment of the invention which contain a storage hole, an outer anchoring hole, and an inner anchoring hole in which an anchoring bar is disposed.
Figure 6B:
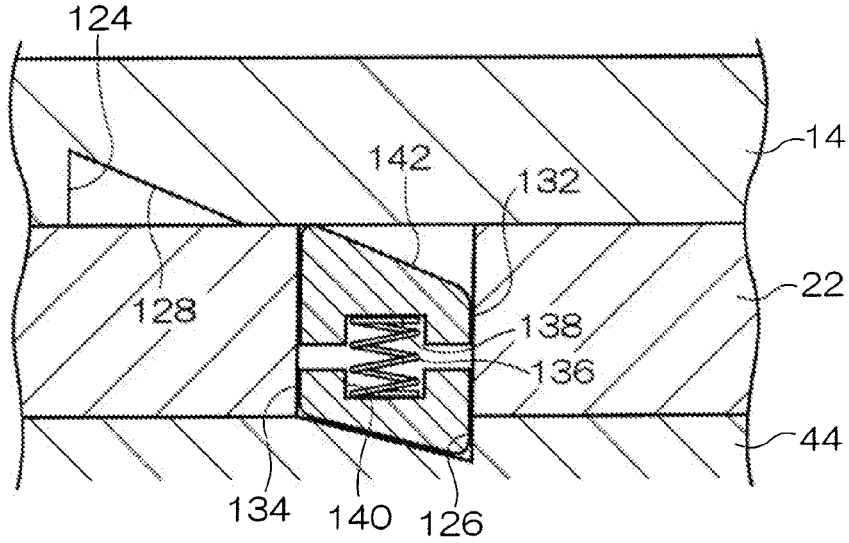
Figure 6C:
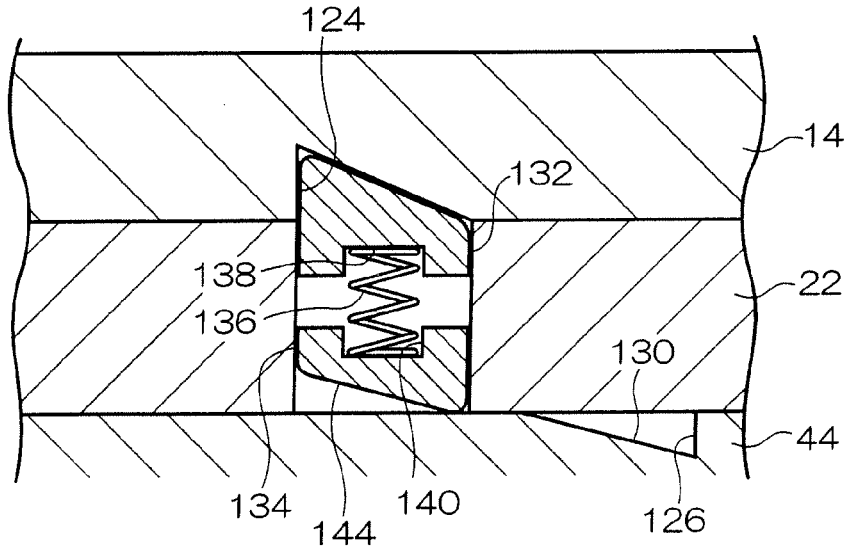

Each of the inner anchoring holes 126 and outer anchoring holes 124 assumes a rectangular cross-sectional shape as taken in the axial direction. As shown in FIG. 6A, each outer anchoring hole 124 is formed by a slanted surface 128 having an outer bottom portion that is outwardly slanted from the rear side toward the front side in the axial direction. As shown in FIG. 6C, each inner anchoring hole 126 has an inner bottom portion that is formed by a slanted surface 130 which is slanted in the same direction as the slanted surface 128 of the outer anchoring hole 124 but slanted at a smaller angle than the slanted surface 128 with respect to the axis of the device.

When the sleeve member 22 and plunger member 42 are in the standby position, the storage hole 106 in the sleeve member 22 is in registry with the outer anchoring holes 124 and inner anchoring holes 126 both axially and widthwise of the device. The storage hole 106 has an axially taken cross-sectional shape identical with the shape of the opening end at the outer anchoring hole 124 and inner anchoring hole 126.

The anchoring bar 122 that is shaped like a rectangular column as a whole is received in the storage hole 106 so as to be slidable in the direction perpendicular to the axial direction. As shown in FIGS. 6A-6C, an outer anchoring part 132 is mounted at the outer side of the anchoring bar 122 in the direction perpendicular to the axial direction. An inner anchoring part 134 is mounted at the inner side of the anchoring bar 122. A coil spring 136 is interposed and compressed between the outer anchoring part 132 and the inner anchoring part 134.

The outer anchoring part 132 is formed like a thick-walled plate whose thickness direction lies in the direction perpendicular to the axial direction. The axially taken cross-sectional shape at the inner side of the outer anchoring part 132 is a rectangular form conforming to the cross-sectional shape of the storage hole 106. The outer anchoring part 132 has an inner side end surface, and a circular concave seat-receiving portion 138 is formed at the center of this inner side end surface. The coil spring 136 has an outer side end portion inserted in the seat-receiving portion 138. The outer side end surface of the outer anchoring part 132 is formed as a cam surface 142 made of a flat plane parallel to the slanted surface 128 of the outer anchoring hole 124. The outer anchoring part 132 is slidably inserted in the storage hole 106 and has an outer side end portion that can be inserted into and withdrawn from the outer anchoring hole 124.

The inner anchoring part 134 is shaped like a thick-walled plate whose direction of thickness lies in the direction perpendicular to the axial direction similarly to the outer anchoring part 132. The axially taken cross-sectional shape at the outer side is a rectangular form that conforms to the cross-sectional shape of the storage hole 106. The inner anchoring part 134 has an outer side end surface, and a circular concave seat-receiving portion 140 is formed in the center of this outer side end surface. The coil spring 136 has an inner end portion inserted in the seat-receiving portion 140. The inner anchoring part 134 has an inner side end surface that is formed as a cam surface 144 made of a flat plane parallel to the slanted surface 130 of the inner anchoring hole 126. The inner anchoring part 134 is slidably inserted in the storage hole 106 and has an inner side end portion that can be inserted into and withdrawn from the inner anchoring hole 126.

When the sleeve member 22 and plunger member 42 are in the standby position, the outer anchoring part 132 of the anchoring bar 122 is withdrawably inserted into the outer anchoring hole 124. Also, the inner anchoring part 134 of the anchoring bar 122 is withdrawably inserted into the inner anchoring hole 126. At this time, the cam surface 142 of the outer anchoring part 132 is pressed against the slanted surface 128 by the biasing force of the coil spring 136. The cam surface 144 of the inner anchoring part 134 is pressed against the slanted surface 130 by the biasing force of the coil spring 136.

In the locking device 120, if the authentic key 12R is inserted into the keyway 48 and the plunger member 42 starts to move from the standby position toward the operative position, a pushing force acts on the cam surface 144 of the inner anchoring part 134 from the outer surface of the plunger member 42. Also, a pushing force acts on the cam surface 142 of the outer anchoring part 132 from the inner surface of the case member 14. Since the slant angle of the cam surface 144 to the axial direction is smaller than the slant angle of the cam surface 142, the pushing force acting on the cam surface 144 from the outer surface of the plunger member 42 becomes greater than the pushing force acting on the cam surface 142 from the inner surface of the case member 14.

Figure 5A:
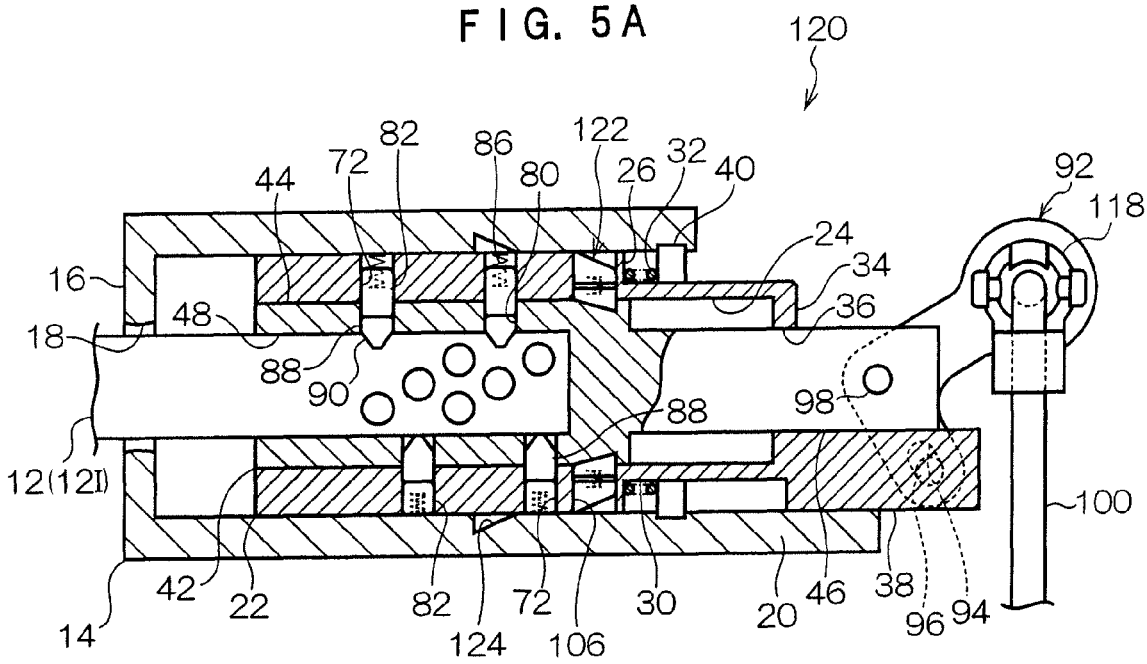
FIG. 5A is a side elevation in cross section of a locking device associated with the second embodiment of the invention, and in which an inauthentic key has been inserted in the keyway and a sleeve member and a plunger member together have moved to the operative position.
Figure 5B:
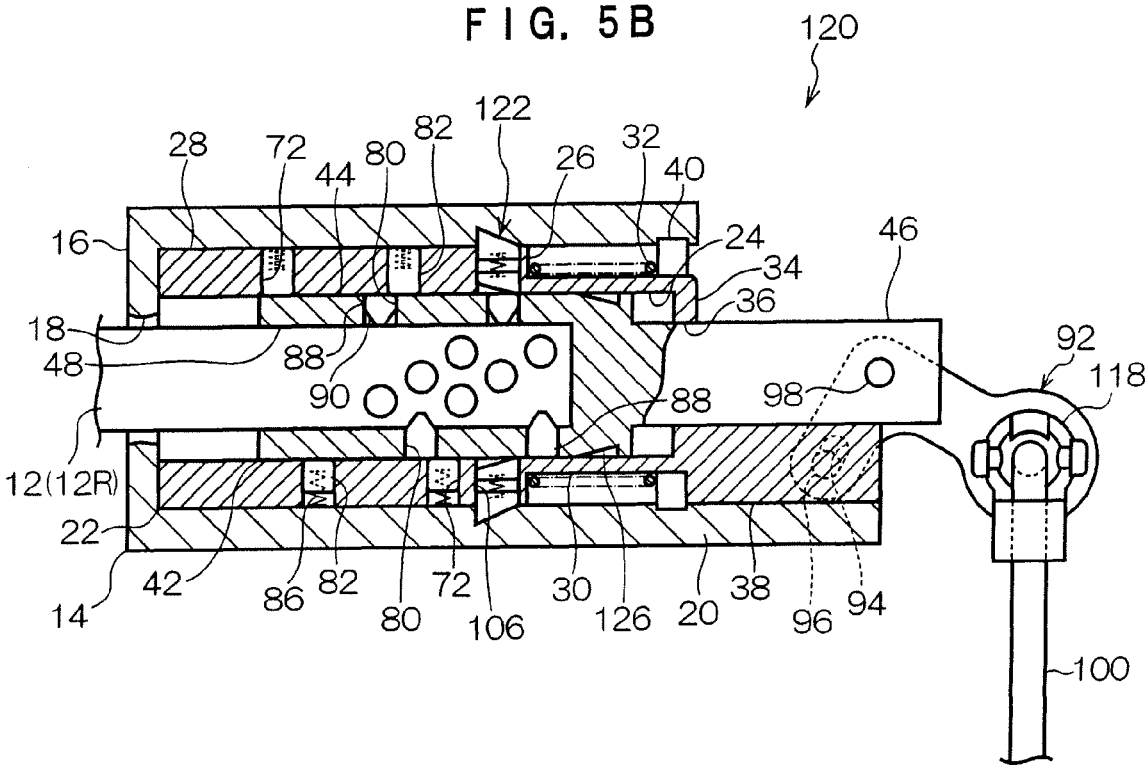
FIG. 5B is a side elevation similar to FIG. 5A, but in which an authentic key has been inserted in the keyway and only the plunger member has moved to the operative position.

Accordingly, in the locking device 120, if the authentic key 12R is inserted into the keyway 48 and the plunger member 42 starts to move from the standby position toward the operative position, the outer anchoring part 132 is kept inserted in the outer anchoring hole 124 as shown in FIG. 6C. However, the pushing force from the outer surface of the plunger member 42 forces the inner anchoring part 134 out of the inner anchoring hole 126. As a result, in the locking device 120, as shown in FIG. 5B, the sleeve member 22 is confined in the standby position by the outer anchoring part 132 of the anchoring bar 122. Only the plunger member 42 is moved from the standby position to the operative position reliably by the pushing force from the authentic key 12R. Furthermore, if the plunger member 42 that has moved to the operative position is returned to the standby position, the inner anchoring part 134 of the anchoring bar 122 is inserted into the inner anchoring hole 126 by the biasing force of the coil spring 136.

Further, in the locking device 120, if the inauthentic key 12I is inserted into the keyway 48 and if the plunger member 42 starts to move from the standby position toward the operative position while connected with the sleeve member 22 by the outer pin 82 or inner pin 88, a pushing force acts on the cam surface 142 of the outer anchoring part 132 by the inner side surface of the case member 14. The pushing force makes the outer anchoring part 132 go out from the outer anchoring hole 124 as shown in FIG. 6B. Consequently, in the locking device 120, the sleeve member 22 and plunger member 42 together move from the standby position to the operative position while the anchoring bar 122 is retained in the inner anchoring hole 126 and in the storage hole 106 as shown in FIG. 5A. When the sleeve member 22 and plunger member 42 which have moved to the operative position return to the standby position, the outer anchoring part 132 in the anchoring bar 122 is inserted into the outer anchoring hole 124 by the biasing force of the coil spring 136.

Operation of the Embodiment

The operation of the locking device 120 associated with the present embodiment is next described.

In the locking device 120 associated with the present embodiment, when the operator inserts the authentic key 12R into the keyway 48 and pushes the key 12R in the axial direction of the device, the body portion of the locking mechanism is unlocked. The body portion of the locking mechanism can be kept locked if the inauthentic key 12I is inserted in the same way as in the locking device 10 associated with the first embodiment. Therefore, when the key is manipulated by the operator, it is not necessary to transmit torque by the key 12, unlike the rotary locking device having the manipulated mechanism of rotating the key. Only a load in the axial direction acts on the key 12. Consequently, the required mechanical strength of the key 12 in the twisting direction can be made sufficiently small.

Furthermore, in the locking device 120, when the authentic key 12R is inserted into the keyway 48 and the plunger member 42 begins to move from the standby position toward the operative position, the anchoring bar 122 confines the sleeve member 22 in the standby position. Therefore, when the plunger member 42 moves from the standby position to the operative position, it is assured that the sleeve member 22 can be held in the standby position. Hence, for example, the sleeve member 22 does not move from the standby position to the operative position by frictional force from the plunger member 42. The operating lever 92 can be swung from the locked position to the unlocked position reliably.

In the description of the present embodiment provided above, the locking devices 10 and 120 are applied to the locking mechanism for locking and unlocking the open-close member. The locking devices 10 and 120 associated with the present embodiments can be applied to any manipulated mechanism as long as the mode of operation is varied from one mode of operation to the other (e.g., from inoperative to operative state or vice versa) by manipulation of the authentic key 12R.

Furthermore, in the locking devices 10 and 120, the connecting shaft 96 of the sleeve member 22 is connected relatively rotatable to the operating lever 92 and the pushing shaft 98 of the plunger member 42 is connected relatively rotatable to the operating lever 92. However, the shaft 98 may only be pressed against an end surface of the base end of the lever 92 without being rotatably connected thereto. Where the pushing shaft 98 is pressed against the operating lever 92 in this way, the pushing force from the plunger member 42 is transmitted to the operating lever 92 via the pushing shaft 98. As the plunger member 42 is moved toward the operative position, the operating lever 92 can be swung toward the unlocked position. Furthermore, in this case, it is not necessary to permit the connecting shaft 96 to move longitudinally of the operating lever 92. The connecting hole 94 in the operating lever 92 may be formed as a round hole having an inside diameter corresponding to the outside diameter of the connecting shaft 96.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A locking device comprising:

a case member having an internal space extending in an axial direction;

a sleeve member disposed within and supported by the case member and axially movable in the axial direction;

a plunger member disposed inside the sleeve member and supported by the sleeve member so as to be movable in the axial direction between a given standby position and a given operative position;

a keyway formed inside the plunger member so as to extend in the axial direction, and a key being insertable therein from the axial direction outside of the plunger member when the plunger member is in the standby position; and an operation-selecting unit that, when an authentic key is inserted in the keyway and the plunger member moves axially from the standby position to the operative position together with the authentic key in the case member but the sleeve member does not move axially relative to the case member, operates a key-operated mechanism, and that, when an inauthentic key is inserted in the keyway and the plunger member moves axially relative to the case member from the standby position to the operative position together with the inauthentic key and the sleeve member, maintains the key-operated mechanism in an inoperative state.

2. A locking device as set forth in claim 1, further comprising an operating lever pivotally connected to both said sleeve member and said plunger member such that relative axial movement of said sleeve member and said plunger member in opposite directions swingably moves said operating lever into an unlocking position, but joint axial movement in a same direction does not swingably move said operating lever into an unlocking position.

3. A locking device comprising:

a case member having an internal space extending in an axial direction;

a sleeve member disposed inside the case member and supported by the case member so as to be movable between a given standby position and a given operative position in the axial direction;

a plunger member disposed inside the sleeve member so as to be movable in the axial direction, and supported by the case member via the sleeve member so as to be movable between the standby position and the operative position in the axial direction;

a keyway which is formed inside the plunger member, extends in the axial direction, and a key being insertable therein from the axial direction outside of the plunger member when the plunger member is in the standby position;

a key-judging unit that, when an inauthentic key is inserted in the keyway, connects the sleeve member with the plunger member such that the sleeve member and the plunger member move together in the axial direction, and that, when an authentic key is inserted in the keyway, disconnects the sleeve member from the plunger member such that the sleeve member and the plunger member move in the axial direction away from one another; and an interlocking unit that, when an authentic key is inserted in the keyway and the plunger member is moved together with the authentic key into the operative position while the sleeve member disconnected from the plunger member by the key-judging unit is left in the standby position, operates a key-operated mechanism, and that, when an inauthentic key is inserted in the keyway and the sleeve member and the plunger member connected together by the key-judging unit are moved into the operative position together with the inauthentic key, maintains the key-operated mechanism in an inoperative state.

4. A locking device of claim 3, wherein the interlocking unit is an operating lever that is connected to the key-operated mechanism and provided so as to be swung between an OFF position where the key-operated mechanism is kept inoperative and an ON position where the key-operated mechanism is operated.

5. A locking device of claim 4, further comprising:

a rotary connection portion provided to the sleeve member and connected rotatable relative to the operating lever; and a pressing portion provided to the plunger member and engaging the operating lever, wherein when the plunger member moves toward the operative position, the pressing portion transmits a pushing force to the operating lever; wherein, when the rotary connection portion and the pressing portion are in the standby position, the operating lever is retained in the OFF position;

when the pressing portion is moved from the standby position toward the operative position while the rotary connection portion is left in the standby position, the operating lever receives the pushing force from the pressing portion and swings toward the ON position with the rotary connection portion as a rotation center; and when the pressing portion reaches the operative position, the lever swings to the ON position.

6. A locking device as set forth in claim 3, wherein, the key-judging unit has a plurality of engaging members moving relative to the plunger member in directions perpendicular to the axial direction;

wherein when the authentic key is inserted in the keyway, all the engaging members come into engagement with a plurality of engagement portions formed at end portions of the authentic key located in directions perpendicular to the axial direction of the authentic key, disconnecting the sleeve member and the plunger member from each other; and when an inauthentic key is inserted in the keyway, at least one of the engaging members comes into abutment with a portion other than the engagement portions of the inauthentic key, and the sleeve member is connected with the plunger member so as to move integrally together in the in the axial direction.

7. A locking device of claim 3, wherein the key-judging unit comprises:

outer pin holes formed in the sleeve member and extending perpendicularly to the axial direction, and open to an outer surface of the plunger member;

inner pin holes penetrating through the plunger member perpendicularly to the axial direction and registering with the outer pin holes when the sleeve member is in the standby position;

outer pins that are movably inserted in the outer pin holes, are biased inwardly, and have inner side end portions that are withdrawably inserted into the inner pin holes; and inner pins that are slidably inserted in the inner pin holes, have outer side end portions that are withdrawably inserted into the outer pin holes, and have their outer side end surfaces brought into abutment with inner side end surfaces of the outer pins when the sleeve member and the plunger member are in the standby position; wherein, when an authentic key is inserted in the keyway, the inner pins have their inner side end surfaces brought into engagement with the authentic key and have the outer side end surfaces of the inner pins and the inner side end surfaces of the outer pins located boundaries between the outer pin holes and the inner pin holes.

8. A locking device of claim 7, wherein when an inauthentic key is inserted in the keyway, the inner pins have the inner side end portions brought into abutment with the inauthentic key, causing the outer side end surfaces of the inner pins and the inner side end surfaces of the outer pins to be positioned inside or outside with respect to the boundaries between the outer pin holes and the inner pin holes.

9. A locking device as set forth in claim 3, further comprising:

an outer anchoring hole formed in an inner surface of the case member;

a storage hole penetrating through the sleeve member perpendicularly to the axial direction and registering with the outer anchoring hole when the sleeve member is in the standby position;

an anchoring member slidably stored in the storage hole, having an outer side end portion that is withdrawably inserted into the outer anchoring hole and having an inner side end portion that abuts against the outer surface of the plunger member; and a biasing member disposed in the outer anchoring hole and resiliently extending and retracting perpendicularly to the axial direction, and acting to press an inner side end portion thereof against the anchoring member when the sleeve member is in the standby position; wherein, when an authentic key is inserted in the keyway and the plunger member starts to move from the standby position toward the operative position, the outer side end portion of the anchoring member is inserted into the outer anchoring hole against the force of the biasing member due to pushing force from the outer surface of the plunger member and the sleeve member is confined in the standby position.

10. A locking device of claim 9, wherein, in the cross-sectional shape of an inner side end portion of the anchoring member in the axial direction, the depthwise dimension in the direction perpendicular to the axial direction increases from the standby position toward the operative position.

11. A locking device as set forth in claim 9, wherein the anchoring member is so designed that the plunger member is anchored and movement thereof away from the operative position is limited when the plunger member has moved from the operative position to the standby position.

12. A locking device of claim 3, further comprising:

an outer anchoring hole formed in the inner surface of the case member;

an inner anchoring hole formed in the outer surface of the plunger member;

a storage hole penetrating through the sleeve member perpendicularly to the axial direction and registering with the outer anchoring hole and with the inner anchoring hole when the plunger member and the sleeve member are in the standby position; and an anchoring member slidably stored in the storage hole, resiliently extending and retracting perpendicularly to the axial direction, having an outer side end portion that is withdrawably inserted into the outer anchoring hole when the plunger member and the sleeve member are in the standby position and, having an inner side end portion that is withdrawably inserted into the inner anchoring hole; wherein, when an authentic key is inserted in the keyway and the plunger member starts to move from the standby position toward the operative position, the anchoring member confines the sleeve member in the standby position; and the inner side end portion of the anchoring member is disengaged from the inner anchoring hole due to a pushing force from the outer surface of the plunger member, and when an inauthentic key is inserted in the keyway and the sleeve member and the plunger member start to move from the standby position toward the operative position, the outer side end portion of the anchoring member is disengaged from the outer anchoring holes due to a pushing force from the inner surface of the case member.

13. A locking device of claim 12, wherein in a cross-sectional shape of the inner side end portion of the anchoring member taken in the axial direction, the depthwise dimension in the direction perpendicular to the axial direction increases from the standby position toward the operative position, and in a cross-sectional shape of the outer side end portion of the anchoring member in the axial direction, the depthwise dimension in the direction perpendicular to the axial direction increases from the operative position toward the standby position.

14. A locking device as set forth in claim 3, further comprising a key including:

an insertion plate, elongated in the axial direction and insertable into the keyway;

a first engagement end portion formed at an end part in the widthwise direction of the insertion plate and having at least one engagement portion;

a second engagement end portion formed at the other end part in the widthwise direction of the insertion plate and having at least one engagement portion; and an engagement surface formed at a surface in the thickness direction of the insertion plate and having at least one engagement portion.

15. A locking device as set forth in claim 14, wherein in the key, a plurality of reference positions are set on the first engagement end portion, the second engagement end portion, and the engagement surface; and the engagement portions are formed to correspond to the respective reference positions.

16. A locking device as set forth in claim 3, further comprising an operating lever pivotally connected to both said sleeve member and said plunger member such that relative axial movement of said sleeve member and said plunger member in opposite directions swingably moves said operating lever into an unlocking position, but joint axial movement in a same direction does not swingably move said operating lever into an unlocking position.

* * * * *